United States Patent [19]

Meinders et al.

[11] Patent Number: 5,050,573

[45] Date of Patent: Sep. 24, 1991

[54] IGNITION DEVICE FOR AN INTERNAL COMBUSTION ENGINE

[75] Inventors: Horst Meinders, Reutlingen; Ulrich Nelle, Sonnenbühl, both of Fed. Rep. of Germany

[73] Assignee: Robert Bosch GmbH, Stuttgart, Fed. Rep. of Germany

[21] Appl. No.: 477,993

[22] PCT Filed: Jul. 7, 1988

[86] PCT No.: PCT/DE88/00425

§ 371 Date: Apr. 19, 1990

§ 102(e) Date: Apr. 19, 1990

[87] PCT Pub. No.: WO89/03937

PCT Pub. Date: May 5, 1989

[30] Foreign Application Priority Data

Oct. 21, 1987 [DE] Fed. Rep. of Germany ..... 3735631

[51] Int. Cl.[5] ..... F02P 3/12

[52] U.S. Cl. ..... 123/644

[58] Field of Search ..... 123/644, 602, 605, 603, 123/620, 596, 594, 665, 640, 651; 315/209 T

[56] References Cited

U.S. PATENT DOCUMENTS

| | | | |
|---|---|---|---|
| 3,945,362 | 3/1976 | Neuman et al. | 123/148 E |
| 4,106,462 | 8/1978 | Hildebrandt et al. | 123/148 |
| 4,455,989 | 6/1984 | Endo et al. | 123/620 |
| 4,480,624 | 11/1984 | Anderson | 123/602 |
| 4,515,140 | 5/1985 | Enomoto et al. | 123/603 |
| 4,735,187 | 4/1988 | Kato | 123/651 |
| 4,836,176 | 6/1989 | Fujino et al. | 123/640 |
| 4,949,697 | 8/1990 | Ookawa | 123/644 |
| 4,967,718 | 11/1990 | Scarnera | 123/605 |

FOREIGN PATENT DOCUMENTS

| | | |
|---|---|---|
| 3231125A1 | 2/1984 | Fed. Rep. of Germany . |
| 1447597 | 12/1966 | France . |
| 2217566 | 9/1974 | France . |
| 2318323 | 2/1977 | France . |
| 2369433 | 5/1978 | France . |
| 2407363 | 5/1979 | France . |

*Primary Examiner*—Raymond A. Nelli

*Attorney, Agent, or Firm*—Kenyon & Kenyon

[57] ABSTRACT

An ignition device for an internal combustion engine comprises a preselector stage and an output stage for controlling the flow of current through the primary winding of an ignition transformer. The ignition device is particularly suited for an externally ignited internal combustion engine. The output stage comprises a pnp-transistor having its collector terminal directly coupled to a ground connection of the ignition device to improve proper loss dissipation. A decoupling device is coupled between the preselector stage and the output stage, and is provided to protect the preselector stage by decoupling it from the output stage.

8 Claims, 3 Drawing Sheets

IGNITION DEVICE FOR AN INTERNAL COMBUSTION ENGINE

FIELD OF THE INVENTION

The present invention relates to ignition devices for internal combustion engines and, in particular, to ignition devices employing transistors in the output stages thereof.

BACKGROUND INFORMATION

An ignition device for an internal combustion engine is shown in German Patent No. 28 25 830. The ignition device uses a pnp-transistor in its output stage. The primary winding of an ignition transformer is coupled to the collector terminal of the transistor. The emitter terminal of the transistor is coupled to ground by a current measuring resistor. During the operation of the ignition device, there are high power losses at the output stage, which are removed from the collector terminal to a heat sink. However, the collector terminal must also be electrically insulated from the heat sink when a square-shaped voltage appears during the shut-down process. These opposing requirements have been fulfilled by using an electrically-insulating ceramic layer having good thermal conductivity located between the collector terminal and the heat sink. One problem with the ceramic layer, however, is that it makes the assembly of the ignition device considerably more expensive and often does not compensate for the alternating thermal stresses occurring particularly in high power ignition devices.

Ignition devices are also shown in French Patent Nos. 2,407,363 and 2,318,323, U.S. Pat. Nos. 3,945,362 and 4,106,462, and German Patent No. 3,231,125, wherein the emitter terminals of the transistors in the output stages are coupled to ground connections.

SUMMARY OF THE INVENTION

The present invention is directed to an ignition device for an internal combustion engine. The ignition device comprises an ignition transformer including a primary winding and a secondary winding. A direct current source is coupled to the primary winding for supplying electric current thereto. First means are coupled to the primary winding for controlling the flow of electric current therethrough. The first means includes a preselector stage and an output stage. The output stage includes a first transistor having a first conductivity. The collector terminal of the first transistor is directly coupled to a ground connection of the ignition device.

The ignition device further comprises second means coupled between the preselector stage and the output stage for decoupling the output stage from the preselector stage and preventing the uncontrolled starting of the output stage. The second means includes a second transistor. The collector terminal thereof is coupled to the base terminal to the first transistor; the emitter terminal thereof is coupled to the emitter terminal of the first transistor; and the base terminal thereof is coupled to the positive terminal of the direct current source. The second means further includes a first resistor coupled between the base terminal of the second transistor and the positive terminal of the direct current source.

In one ignition device of the present invention, the second means further includes a third transistor having a second conductivity. The collector terminal of the third transistor is coupled to the base terminal of the first transistor. The emitter terminal of the third transistor is coupled to a ground connection of the ignition device. The preselector stage is coupled to the base terminal of the third transistor to control that transistor.

In another ignition device of the present invention, the output stage further includes an electric current measuring device coupled to the primary winding and to the preselector stage. The current measuring device measures the electric current flowing through the primary winding. It in turn transmits signals indicative thereof to the preselector stage. The current measuring device includes a second resistor coupled to the primary winding and to the preselector stage. The second resistor transmits signals to the preselector stage indicative of the voltage drop across the primary winding.

One ignition device of the present invention further comprises a third resistor coupled between one terminal of the second resistor and an input terminal of the preselector stage. The third resistor exhibits a higher resistivity than the second resistor. A fourth resistor is coupled between the other terminal of the second resistor and another input terminal of the preselector stage. The fourth resistor exhibits a higher resistivity than the second resistor. A first zener diode is coupled between the third resistor and the respective input terminal of the preselector stage, and is coupled to ground. A second zener diode is coupled between the fourth resistor and the respective input terminal of the preselector stage, and is coupled to ground. The first and second zener diodes thus protect the respective input terminals of the preselector stage.

In another ignition device of the present invention, the preselector stage includes a fourth transistor and a diode. The anode terminal of the diode is coupled to the emitter terminal of the fourth transistor. The cathode terminal of the diode is coupled to the base terminal of the first transistor and to a ground connection of the ignition device. A fifth transistor is coupled between the cathode terminal of the diode and the ground connection. The diode is provided to protect the reselector stage from voltage peaks across the primary winding.

In another ignition device of the present invention, the second resistor is coupled between the emitter terminal of the first transistor and the ground-side terminal of the primary winding. The ignition device further includes a fifth transistor. The emitter terminal of the fifth transistor is coupled to the ground-side terminal of the primary winding. The collector terminal thereof is coupled to the base terminal of the first transistor. A voltage divider is coupled between the emitter and collector terminals of the fifth transistor. The base terminal of the fifth transistor is in turn coupled to the pick-off of the voltage divider.

One advantage of the ignition device of the present invention is that by using a pnp-transistor in the output stage of the ignition device and by coupling its collector terminal to the ground connection of the device, which has good thermal and electrical conductivity, large power losses can be dissipated with operational reliability. Moreover, without an insulating layer between the collector terminal and the ground connection, the assembly of the ignition device is simplified and thereby made less expensive. Another advantage is that a predominant part of the ignition device can be integrated monolithically in a particularly advantageous manner, whereby small variances in the important electrical characteristic values of the device can be achieved with large scale production.

Other advantages of the device of the present invention will become apparent in view of the following detailed description and drawings taken in connection therewith.

DETAILED DESCRIPTION

Figure 1:
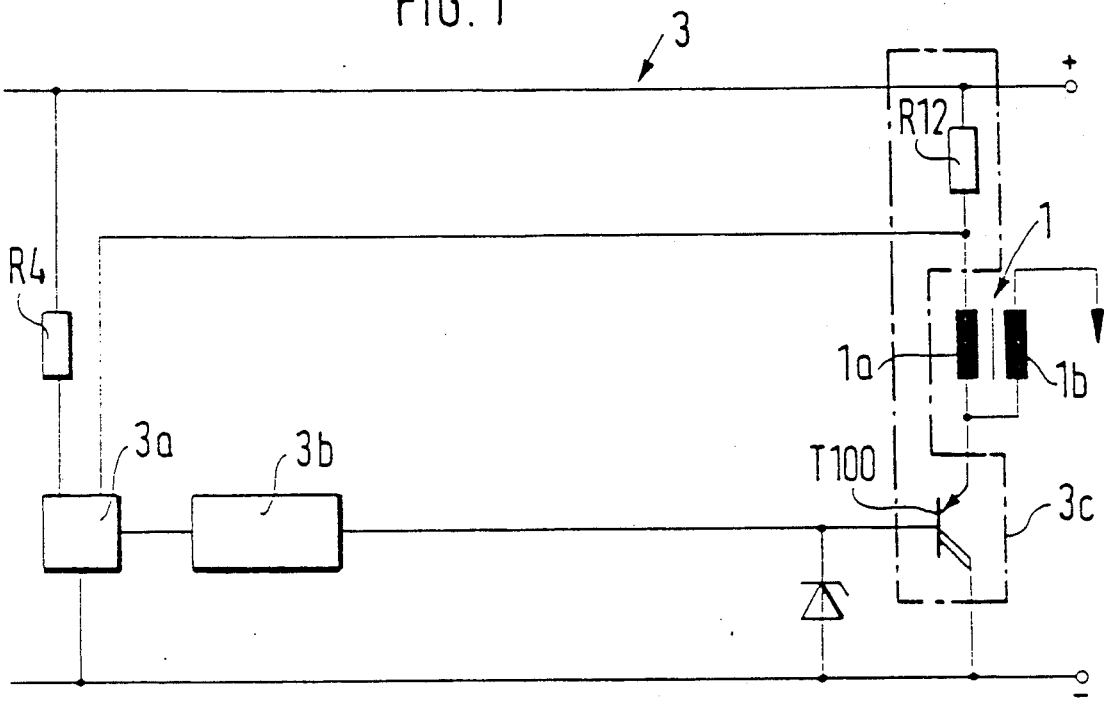
FIG. 1 is a schematic illustration of an ignition device embodying the present invention.

In FIG. 1, an ignition device embodying the present invention is indicated generally by the reference numeral 3. The ignition device 3 is particularly suited for an externally ignited internal combustion engine (not shown). The ignition device 3 includes an ignition transformer 1 having a primary winding 1*a* and a secondary winding 1*b*. Direct current is supplied to the primary winding 1*a* from the positive terminal of a direct current source, as shown in FIG. 1.

The ignition device 3 further comprises a current-controlling device for controlling the current flowing through the primary winding 1*a*. The current-controlling device comprises a preselector stage 3*a* and an output stage 3*c*. The output stage 3*c* includes a transistor T100 having a first type of conductivity. The transistor T100 is preferably a pnp-transistor or a pnp-Darlington transistor. The collector terminal of the transistor T100 is coupled to a ground connection of the ignition device 3. A decoupling device 3*b* is coupled between the preselector stage 3*a* and the output stage 3*c*. The decoupling device 3*b* is provided to decouple the preselector stage 3*a* from the output stage 3*c*. It thus protects the preselector stage 3*a* from the high square-shaped voltage appearing at the output stage 3*c* during the shut-down process.

Figure 2:
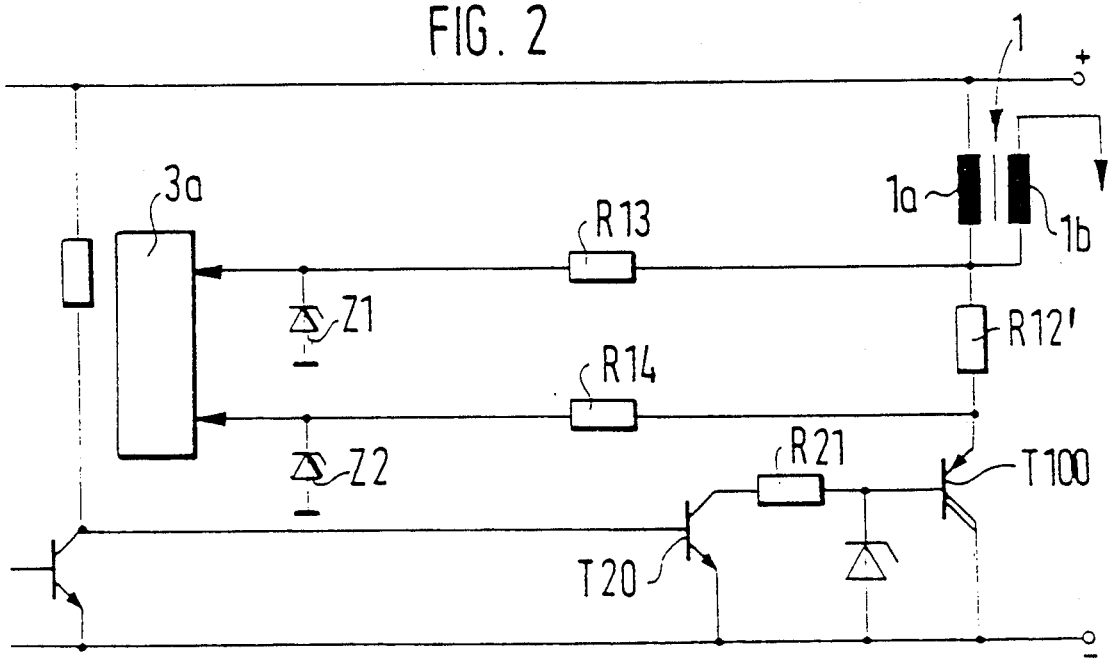
FIG. 2 is a partial schematic illustration of an ignition device embodying the present invention, showing the output stage and the decoupling device in further detail.

In the embodiment of the present invention shown in FIG. 2, the decoupling device 3*b* comprises a transistor T20 having a second type of conductivity. The collector terminal of the transistor T20 is coupled to the base terminal of the transistorr T100 in the output stage 3*c*, and the emitter terminal is coupled to the ground connection of the ignition device 3. The base terminal of transistor T20 is coupled to and controlled by the preselector stage 3*a*. Since the transistor T100 is a pnp-transistor, the decoupling transistor T20 is also a pnp-transistor. The decoupling transistor T20 has at least the same blocking capacity as the square-shaped voltage appearing at the transistor T100.

Figure 3:
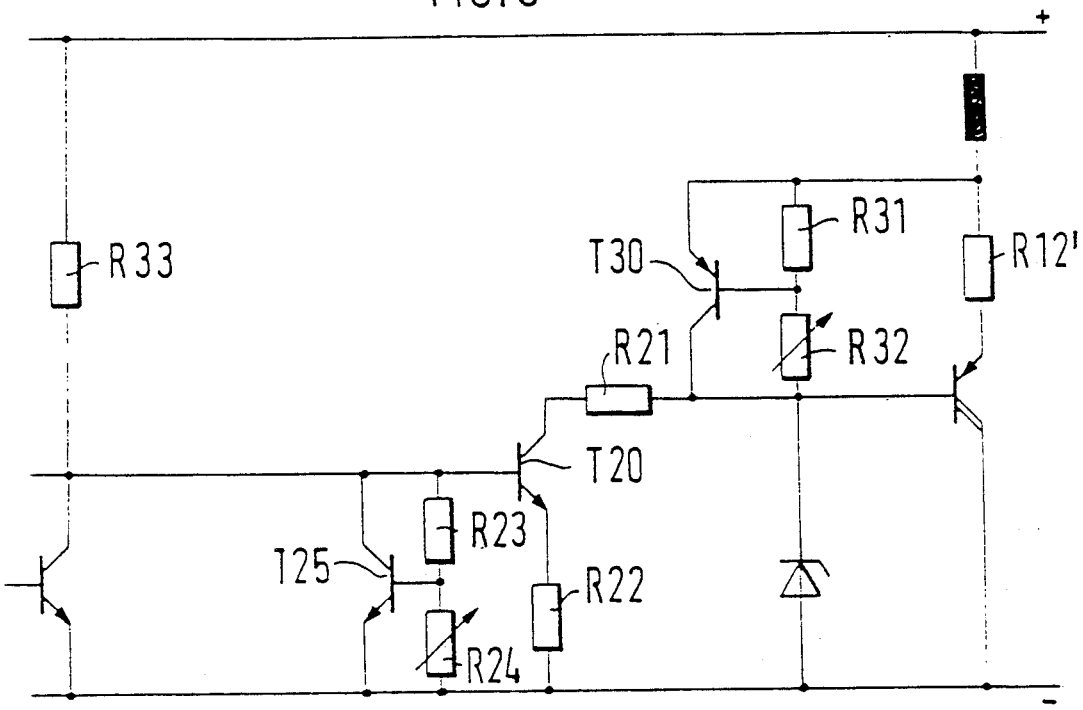
FIG. 3 is a partial schematic illustration of another embodiment of an ignition device embodying the present invention, illustrating the output stage and the decoupling device thereof.

In FIG. 3, another embodiment of an ignition device of the present invention is illustrated. The decoupling device comprises a transistor T20, having its collector terminal coupled to the base terminal of the transistor T100 via a resistor R21. The decoupling device further comprises another transistor T25, coupled in parallel to the emitter/base junction of the transistor T20. The collector terminal of the transistor T25 is coupled to the base terminal of the transistor T20, and the emitter terminal of the transistor T25 is coupled to the ground connection of the ignition device. The emitter terminal of the transistor T20 is also coupled to ground via a resistor R22. The resistor R22 is a current-detecting resistor. There is a voltage drop across the resistor R22 when electric current flows through the transistor T20. As wil be recognized by those skilled in the art, the resistor R22 is a useful control device.

The base terminal of the transistor T25 is located at the pick-off of a voltage divider formed by resistors R23 and R24. The voltage divider is coupled between the base terminal of the transistor T20 and the ground connection of the ignition device. The partial resistor R24 is coupled to the ground connection of the ignition device, and is adjustably designed to determine the base voltage of the transistor T25. The adjustment takes place in a particularly advantageous manner by using auxiliary resistors R31 and R32 coupled in parallel with the resistor R24 and also in series with a zener diode. In the operation of the device, if the zener diode is overloaded, it is destroyed, and the auxiliary resistors are then coupled in parallel to the partial resistor R24. Therefore, in the same way that the current buildup for the transistor T100 is regulated by the transistors T25 and T20, the transistor T30 and resistors R31, R32 can alternatively regulate the emitter current of the transistor T100.

Figure 4:
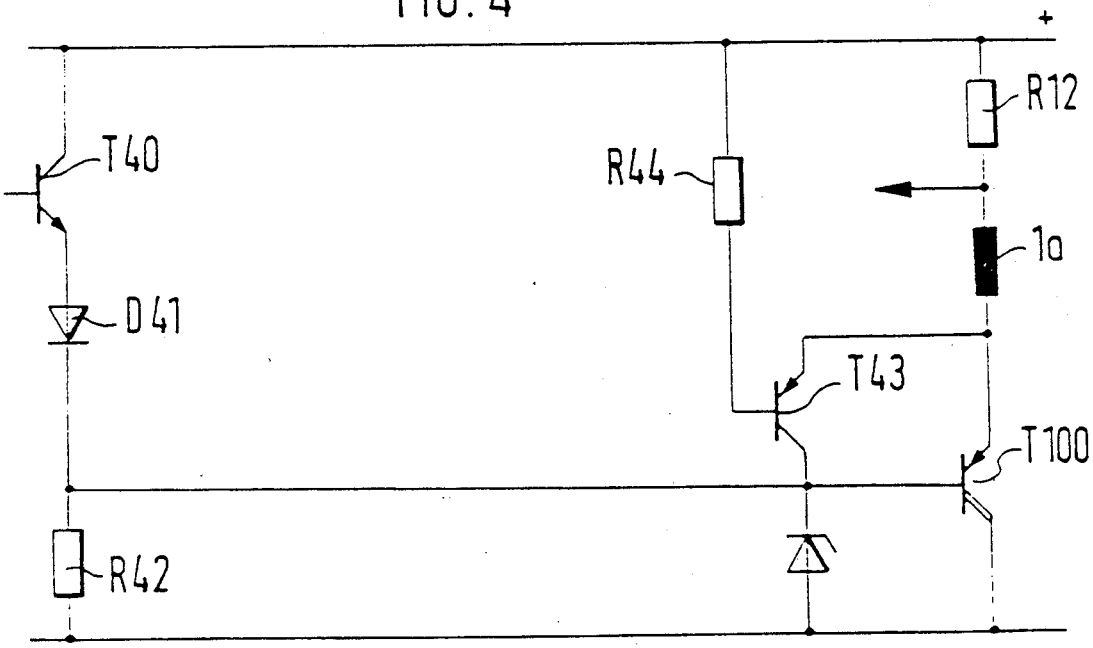
FIG. 4 is a partial schematic illustration of another ignition device embodying the present invention, including means in the output stage for preventing unintentional re-starting thereof and a decoupling diode in the preselector stage.

In FIG. 4, another embodiment of an ignition device of the present invention is illustrated. The decoupling device comprises a diode D41. The anode terminal of the diode D41 is coupled to the emitter terminal of a control transistor T40 in the preselector stage. The cathode terminal of the diode D41 is coupled to the base terminal of the transistor T100. It is also coupled to the ground connection of the ignition device via a load resistor R42. The diode D41 has at least the blocking capacity of the square-shaped voltage appearing at the transistor T100.

One advantage of the ignition device of the present invention is that the transistor T100, mounted with its collector terminal in the output stage 3*c*, is coupled in an electrically conductive manner directly to the ground connection and, therefore, can be directly assembled to a heat sink also coupled to the ground connection. In contrast to conventional ignition devices, the ignition device of the present invention facilitates the dissipation of the power loss occurring during the operation of the ignition device, since no thermal insulating layers are arranged between the collector terminal of the transistor T100 and the heat sink.

Another advantage of the ignition device of the present invention is that its assembly is considerably simplified in comparison to known ignition devices. Therefore, the ignition device of the present invention can typically be produced considerably more economically than conventional ignition devices. To facilitate trouble free operation of the ignition device of the present invention, the decoupling device 3*b* is provided to avoid damaging the preselector stage 3*a* by the high square-shaped voltage appearing during shut-down of the transistor T100.

Another advantage of the ignition device of the present invention is that the uncontrolled restarting of the transistor T100 is reliably prevented after a systematic shut-down thereof. This is achieved by employing an additional transistor T43, as shown FIG. 4. The collector terminal of the transistor T43 is coupled to the base terminal of the transistor T100; the emitter terminal thereof is coupled to the emitter terminal of the transistor T100; and the base terminal thereof is coupled to the positive terminal of the direct current source via a resistor R44. Therefore, the transistor T43 is only activated and switched by its base terminal when its base terminal has a more negative potential than its emitter terminal. However, this only occurs when a square-shaped voltage having a magnitude of about 400 volts appears when the transistor T100 is shut-down (which could restart the transistor).

In the embodiments of the ignition device of FIGS. 1 and 4, a resistor R12 is coupled between the positive terminal of the direct current supply and the terminal of the primary winding 1*a* (which is located away from the ground connection) of the ignition transformer 1, to measure the electric current therethrough. There is a voltage drop across the resistor R12 during the flow of current through the primary winding 1*a*. The voltage drop, or signal indicative thereof, is transmitted to the preselector stage 3*a* for control purposes, as described further below.

In the embodiments of the ignition device of FIGS. 2 and 3, a current measuring resistor R12′ is coupled between the emitter terminal of the transistor T100 and the ground side terminal of the primary winding 1*a* of the ignition transformer 1. In the ignition device of FIG. 2, the voltage drop across the measuring resistor R12′ is picked-off by two resistors R13 and R14, having a higher resistivity than the resistor R12′, and is transmitted to input terminals of the preselector stage 3*a*. The input terminals are protected by zener diodes Z1 and Z2 operating against ground. The high voltage appearing at both terminals of the measuring resistor R12′ during the shut-down phase is uncoupled by the resistors R13 and R14, and the zener diodes Z1 and Z2.

In the ignition device of FIG. 3, another transistor T30 is coupled in parallel to the emitter/base junction of the transistor T100 and the current measuring resistor R12′. The emitter terminal of the transistor T30 is in turn coupled to the ground side terminal of the primary winding 1*a* of the ignition transformer. The collector terminal of the transistor T30 is coupled to the base terminal of the transistor T100. And the base terminal of the transistor T30 is coupled to the pick-off of a voltage divider R31, R32 located between its emitter and collector terminals. As described above in connection with the decoupling transistor T25, the partial resistor R32 of the voltage divider is located closer to the ground connection of the ignition device 3 and is adjustably designed.

One advantage of the preselector stage 3*a*, the output stage 3*c*, and the decoupling device 3*b* of the ignition device 3 is that they can be manufactured with monolithically integrated technology. As a result, extremely small variances in the important electrical characteristic values of the device can be achieved with large scale production. In designing the ignition device 3 with integrated technology, the current measuring resistor R12′ is mounted as a divided resistor at the emitter region of the transistor T100. As a result, a uniform current distribution is obtained over the entire active emitter area of the transistor T100. The current measuring resistor R12′ and the current regulating circuit in the output stage of FIG. 3, are integrated into the emitter/base junction of the pnp-transistor T100. The transistor T30 is designed as a lateral pnp-transistor. In the same way, the decoupling device of FIG. 3 can be integrated with the transistors T20 and T25.

The transistor T43 in the ignition device of FIG. 4, which prevents uncontrolled restarting of the transistor T100, can likewise be integrated monolithically as a lateral pnp-transistor into the base/emitter junction of the transistor T100 mounted in the output stage 3*c*. Both the control stage 3*a* and the transistors T20, T25, or the decoupling diode D41 (provided for decoupling purposes), are attached to the thick layer integrated circuit as separate chips and are coupled to the rest of the circuit by bonded connections. The resistors R33, R44 and R12 are preferably thick-layer film resistors.

Figure 5:
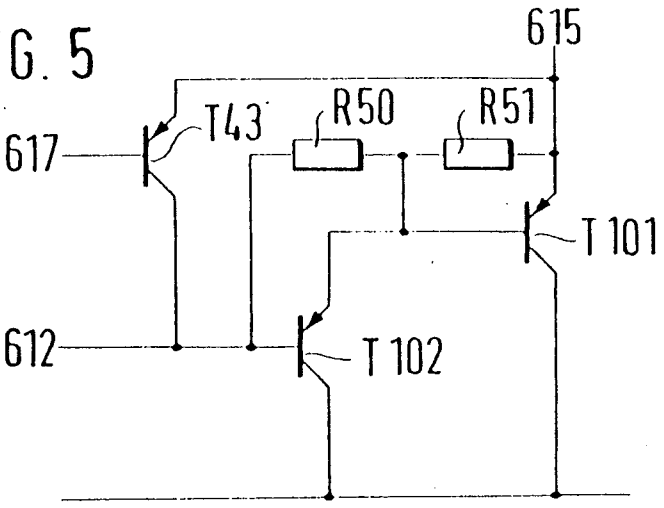
FIG. 5 is a schematic illustration of the output stage of an ignition device embodying the present invention designed with monolithically integrated technology.
Figure 6:
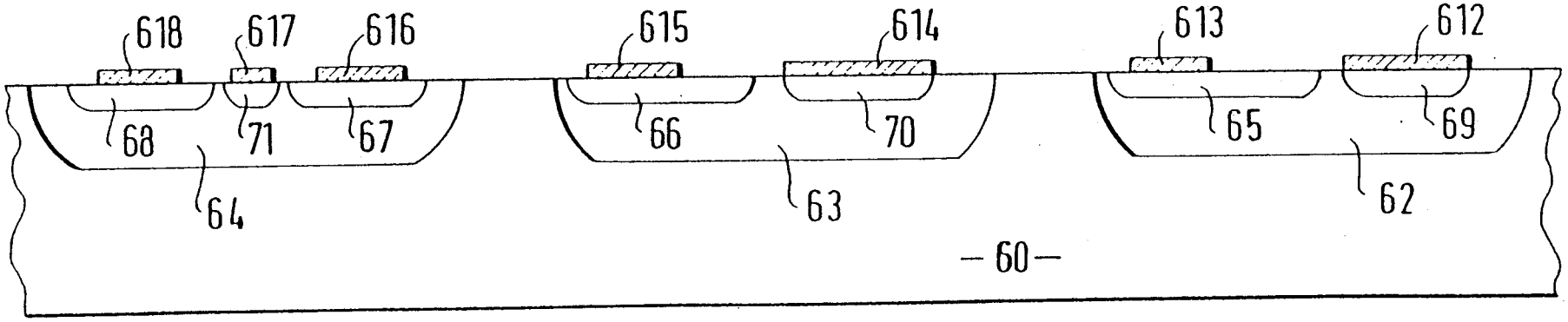
FIG. 6 is a partial cross-sectional view of a semiconductor substrate used in the ignition device of the present invention.

FIGS. 5 and 6 illustrate the output stage 3*c* of the ignition device 3 designed to be monolithically integrated. FIG. 5 illustrates the circuit diagram of the output stage and FIG. 6 is a cross-sectional view of a semiconductor substrate. The output transistor T100 is designed as a two-stage Darlington transistor including components T101 and T102. In accordance with the embodiment of FIG. 4, the transistor T43 is short-circuit proof and designed as a pnp-lateral transistor. The integration of the resistors R50 and R51, as shown in FIG. 5, is achieved in a manner known to those skilled in the art and is therefore not shown in FIG. 6.

As shown in FIG. 6, the semiconductor substrate includes a highly resistant, p-conducting substrate 60 into which n-conducting base heat sinks 62, 63 and 64 are diffused therein. Highly doped p-conducting emitter zones 65, 66, 67 and 68 are in turn diffused into the heat sinks 62, 63 and 64, respectively. The heat sinks 62 and 63 represent the bases of the transistors T101 and T102 of the Darlington transistor, respectively. The heat sink 64 represents the base heat sink surrounding the lateral (short-circuit proof) transistor T43. The other sinks 69, 70 and 71 are made of n-conducting silicon and are highly doped with phosphorus. The sinks 69, 70 and 71 include low-resistant contacts 612, 614 and 617, respectively, on the otherwise highly resistant base heat sinks doped with phosphorus. The highly doped phosphorus layers exert a gettering action, which is favorable for both blocking and for the amplification of the transistors T43, T101 and T102.

The external connecting lines 612 to 618 are coupled to each other as hereinafter described. The transistors T101 and T102 are coupled into a Darlington pair by coupling the terminals 613 and 614 together. The terminal 612 is the external base terminal and the terminal 615 is the external emitter terminal of the Darlington transistor. For integrating the pnp-lateral transistor T43, its lateral collector terminal 618 is coupled to the base terminal 612 of the Darlington transistor T101, T102. The lateral emitter terminal 616 of the transistor T43 is coupled to the emitter terminal 615 of the Darlington transistor. The transistor configuration therefore comprises three external terminal regions: 612 (the base of the Darlington transistor), 617 (the base of the lateral transistor), and 615 (the emitter of the Darlington transistor).

We claim:

1. An ignition device for an internal combustion engine, comprising:

an ignition transformer including a primary winding and a secondary winding;

a direct current source coupled to the primary winding for supplying electric current thereto;

first means coupled to the primary winding for controlling the flow of electric current therethrough, the first means including a control stage and an output stage, the output stage including a first transistor having a first conductivity, the collector terminal of the first transistor being directly coupled to a ground connection of the ignition device;

second means coupled between the control stage and the output stage for decoupling the output stage from the control stage and preventing the uncontrolled starting of the output stage, the second means including a second transistor, the collector terminal thereof being coupled to the base terminal of the first transistor, the emitter terminal thereof being coupled to the emitter terminal of the first transistor, and the base terminal thereof being coupled to the positive terminal of the direct current source, the second means father including a first resistor coupled between the base terminal of the second transistor and the positive terminal of the direct current source.

2. An ignition device as defined in claim 1, wherein the second means further includes a third transistor having a second conductivity, the collector terminal thereof being coupled to the base terminal of the first transistor, and the emitter terminal thereof being coupled to a ground connection of the ignition device, and wherein the control stage is coupled to the base terminal of the third transistor to control the third transistor.

3. An ignition device as defined in claim 2, wherein the output stage further includes an electric current measuring device coupled to the primary winding and to the control stage for measuring the electric current flowing through the primary winding and for transmitting signals indicative thereof to the control stage.

4. An ignition device as defined in claim 3, wherein the current measuring device includes a second resistor coupled to the primary winding and to the control stage, the second resistor transmitting signals to the control stage indicative of the voltage drop across the primary winding.

5. An ignition device as defined in claim 4, further comprising:

a third resistor coupled between one terminal of the second resistor and an input terminal of the control stage, the third resistor exhibiting a higher resistivity than the second resistor;

a fourth resistor coupled between the other terminal of the second resistor and another input terminal of the control stage, the fourth resistor exhibiting a higher resistivity than the second resistor;

a first zener diode coupled between the third resistor and the respective input terminal of the control stage, and coupled to ground; and a second zener diode coupled between the fourth resistor and the respective input terminal of the control stage, and coupled to ground, the first and second zener diodes thus protecting the respective input terminals of the control stage.

6. An ignition device as defined in claim 4, wherein the control stage includes a fourth transistor;

a diode, the anode terminal thereof being coupled to the emitter terminal of the fourth transistor, and the cathode terminal thereof being coupled to the base terminal of the first transistor and to a ground connection of the ignition device; and a fifth resistor coupled between the cathode terminal of the diode and the ground connection, the diode thus being provided to protect the control stage from voltage peaks across the primary winding.

7. An ignition device as defined in claim 4, wherein the second resistor is coupled between the emitter terminal of the first transistor and the ground-side terminal of the primary winding; and the ignition device further includes a fifth transistor, the emitter terminal thereof being coupled to the ground-side terminal of the primary winding, and the collector terminal thereof being coupled to the base terminal of the first transistor; and a voltage divider coupled between the emitter and collector terminals of the fifth transistor, wherein the base terminal of the fifth transistor is coupled to the pick-off thereof.

8. An ignition device as defined in claim 1, wherein the control stage, the output stage and the decoupling device are monolithically integrated.

* * * * *

UNITED STATES PATENT AND TRADEMARK OFFICE

CERTIFICATE OF CORRECTION

PATENT NO. : 5 050 573

DATED : September 24, 1991

INVENTOR(S) : Horst MEINDERS et al.

It is certified that error appears in the above-identified patent and that said Letters Patent is hereby corrected as shown below:

On the title page:

In the Abstract, line 9, change "proper" to read --power--;

in Column 1, line 58, change "to" to read --of--;

Signed and Sealed this

Sixth Day of April, 1993

*Attest:*

STEPHEN G. KUNIN

*Attesting Officer*

*Acting Commissioner of Patents and Trademarks*